United States Patent [19]

Nowak

[11] 4,161,509

[45] Jul. 17, 1979

[54] MONOLITHIC CONVERTER

[75] Inventor: Hubert H. Nowak, Jackson, Mich.

[73] Assignee: Tenneco., Inc., Racine, Wis.

[21] Appl. No.: 567,578

[22] Filed: Apr. 14, 1975

[51] Int. Cl.[2] ..... B01J 1/14; F01N 3/08; F01N 3/15

[52] U.S. Cl. ..... 422/179; 422/180; 60/299; 60/322

[58] Field of Search ..... 23/288 FC, 288 F, 288 FA; 60/322, 299-302; 151/38; 248/358 AA; 423/230, 239, 244, 247, 212 C

[56] References Cited

U.S. PATENT DOCUMENTS

| | | | |
|---|---|---|---|
| 1,422,211 | 7/1922 | Lamb | 423/247 |
| 2,033,100 | 3/1936 | Kellogg | 151/38 |
| 2,683,016 | 7/1954 | Campbell | 248/358 AA |
| 3,018,841 | 1/1962 | Gerlich | 23/288 FC |
| 3,084,009 | 4/1963 | Heym | 248/358 AA |
| 3,088,271 | 5/1963 | Smith | 23/288 FC |
| 3,166,895 | 1/1965 | Slayter et al. | 23/288 FC |
| 3,211,534 | 10/1965 | Ridgway | 23/288 FC |
| 3,248,188 | 4/1966 | Chute | 23/288 FC |
| 3,801,289 | 4/1974 | Wiley | 23/288 FC |
| 3,815,635 | 6/1974 | Jansen | 151/38 |
| 3,817,714 | 6/1974 | Wiley | 23/288 FC |
| 3,841,839 | 10/1974 | Wile y | 23/288 FC |
| 3,841,842 | 10/1974 | Wiley | 23/288 FC |
| 3,852,042 | 12/1974 | Wagner | 23/288 FC |
| 3,948,611 | 4/1976 | Stawsky | 60/299 |
| 4,004,887 | 1/1977 | Stormont | 23/288 FC |

*Primary Examiner*—Sidney Marantz
*Assistant Examiner*—Bradley Garris
*Attorney, Agent, or Firm*—Harness, Dickey & Pierce

[57] ABSTRACT

A catalytic converter unit of the type used in internal combustion engine exhaust systems has a monolithic refractory catalyst element which is axially retained by means of annular spring washers.

11 Claims, 5 Drawing Figures

Fig. 1.
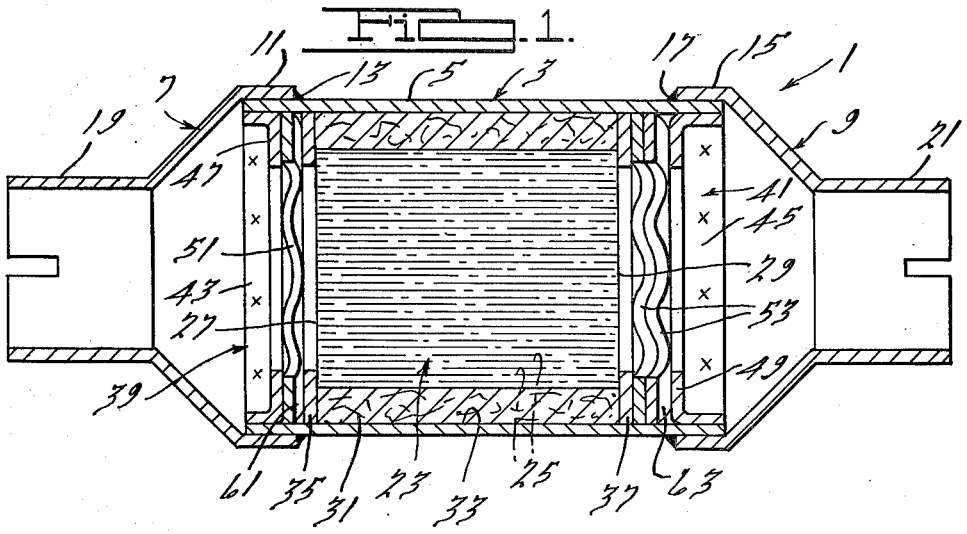
Fig. 2.
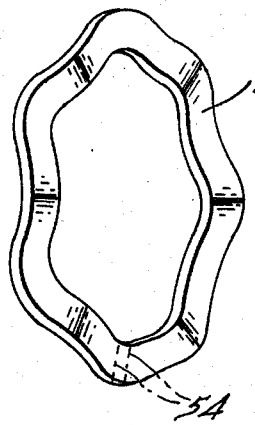
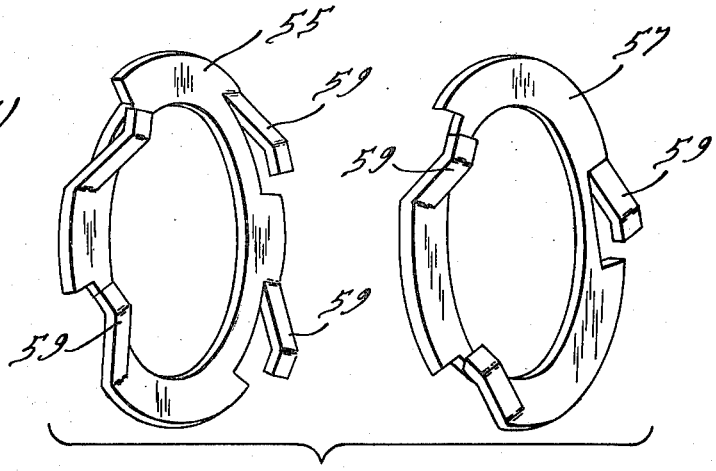
Fig. 3.
Fig. 5.
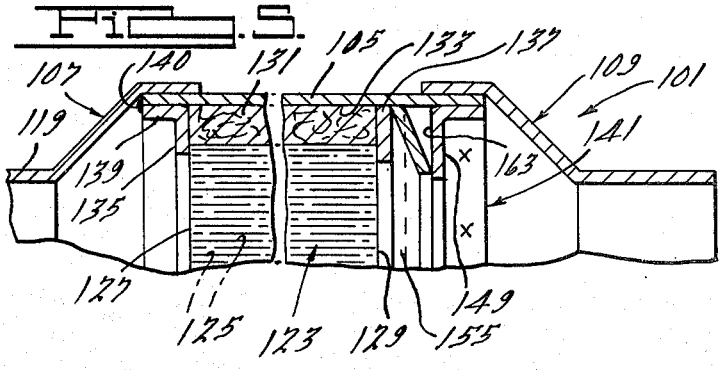
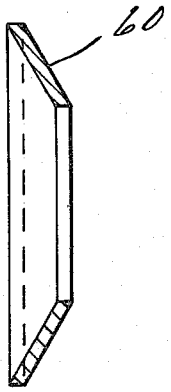
Fig. 4.

MONOLITHIC CONVERTER

BACKGROUND OF THE INVENTION

Monolithic catalyst support elements or substrates that are used in emission control devices (i.e., catalytic converters) for motor vehicle, gasoline-fueled, internal combustion engines are composed of refractory materials that have a low coefficient of thermal expansion and are relatively brittle. U.S. Pat. No. 3,441,381, used Apr. 29, 1969, to Keith et al, describes one such catalyst element. A catalytic converter also includes a housing for the catalyst element and it is composed of metal having a relatively high coefficient of expansion compared to the refractory. The temperature differential between the metal and refractory can vary from zero to over 1000° F. This large differential in combination with the very different rates of expansion creates difficult problems in properly retaining the catalyst element. On the one hand it is necessary to avoid clearance that would permit the catalyst element to move and be cracked, chipped, or extruded. On the other hand, it is also necessary to avoid interference which could cause the catalyst element to be cracked or crushed thereby leading to clearance and associated damage.

In addition to troublesome thermal conditions, the conditions under which a motor vehicle is operated can cause mechanical damage to an improperly mounted monolithic refractory catalyst element. Constant or excessive vibration, shock loads, etc., occur regularly in driving and it is necessary to insulate the catalyst element from them.

Further, in manufacturing, storage, installation, and general handling, the converter is likely to be dropped or thrown around in such a way as to be subjected to severe shock loads that are capable of damaging the brittle refractory.

BRIEF SUMMARY OF THE INVENTION

It is the purpose of the invention to provide a catalytic converter with means for axially retaining a monolith refractory catalyst element in a metal housing in such a way as to minimize the possibility of damage to the element due to thermal loads, operating loads, and rough handling.

In accomplishing this the invention provides at least one annular spring washer that is positioned and arranged in the housing or container to continuously apply axial spring pressure to an end of the catalyst element. Since spring washers have minimum axial length, resilient axial retention is achieved in a housing of minimum length.

DESCRIPTION OF THE DRAWINGS

FIG. 1 is a longitudinal section along the axis of a catalytic converter containing a catalyst element mounted in accordance with the invention;

FIG. 2 is a perspective view of a wave type spring washer used in the structure of FIG. 1;

FIG. 3 is a perspective view of two slightly different finger type spring washers that may be used in practicing certain aspects of the invention;

FIG. 4 is a cross section of a Belleville type spring washer that may be in practicing certain aspects of the invention; and FIG. 5 is a half section of the kind shown in FIG. 1 but shows the spring washer in combination with the use of two metals having different coefficients of thermal expansion as disclosed in the copending U.S. application Ser. No. 342,280, filed Mar. 16, 1973, of Robert N. Balluff and James D. Stormont which is assigned to the assignee hereof.

The symbol "x" in the drawings indicates a spotweld.

DETAILED DESCRIPTION OF THE INVENTION

In FIG. 1 a throwaway catalytic converter 1 has a housing or container 3 which includes a tubular center section 5, a conically shaped inlet section or cap 7, and a conically shaped outlet section or cap 9. The inlet section has a circumferential flange 11 that fits over the inlet end of the center shell 5 and is welded to it as indicated at 13. Similarly, the outlet section has a circumferential flange 15 that fits around the outlet end of the shell and is welded to it as indicated at 17. The inlet cone 7 has a reduced diameter portion 19 providing an inlet bushing for attachment by clamping or otherwise to a conduit in the exhaust system of a motor vehicle internal combustion engine, and, similarly, the outlet cone 9 has a reduced diameter section 21 providing an outlet bushing to be secured to a conduit in the exhaust system.

Located inside of the shell 5 is a catalyst element which is illustrated as comprising a catalyst support block or substrate of the type disclosed in detail in U.S. Pat. No. 3,441,381 of Apr. 29, 1969 to Keith et al, though other substrates may be used in the converter 1 and benefit by the practice of the invention. The block 23 is a relatively brittle refractory material that has a great number of channels or passages 25 extending axially or longitudinally through it from its inlet face 27 to its outlet face 29 thereby enabling gas that enters the unit through the inlet cone 7 to flow directly through the container along substantially straight lines (i.e., axial flow) to reach the outlet cone 9. As described in U.S. Pat. No. 3,441,381, the block 23 is turned into a catalyst element by the deposition of a suitable catalyst material on the walls of the passages 25 to promote the desired conversion of emissions in the exhaust gas that flows through the passages.

An annular circumferential layer 31 of suitable composition extends around the outer periphery of the block 23 to mount it on the cylindrical inside wall 33 of the sleeve 5. This layer 31 is resilient to provide shock insulation in a radial direction for the frangible catalyst element 23. The layer may be formed of metallic mesh, as mentioned in U.S. Pat. No. 3,441,381, or a high temperature resisting non-metallic but resilient fibrous layer such as described in U.S. Pat. No. 3,771,967, issued Nov. 13, 1973, of Hubert H. Nowak that is assigned to the assignee of the present invention.

As is known, the reaction that occurs in the element 23 is ordinarily accompanied by the release of a great amount of heat so that the temperature of the converter 1 may reach levels that are rapidly destructive of ordinary metals. It is considered desirable to make the shell 5 of a temperature and corrosion resistant material such as A.I.S.I. 409 stainless which has an average coefficient of thermal expansion of about $7.5\times10^{-6}$ in./in./°F. (80°–1800° F.). Refractory catalyst elements 23, however, can have a coefficient of thermal expansion of about 0.5 to $3.5\times10^{-6}$ so that expansion of the shell is several times greater than that of the catalyst element. Thus, with an increase in temperature, the shell 5 can be expected to grow in a longitudinal or axial direction a substantially greater amount than the catalyst element 23.

In order to keep the catalyst element 23 from moving longitudinally relative to the shell 5 at room temperature, which movement would create the likelihood of mechanical damage in the handling and/or shipping of the converter unit 1, it is necessary to provide means for axially retaining the element in a substantially given position with respect to the shell 5. For this purpose a pressure ring 35 has an outer diameter that slidably fits on the inside shell surface 33 and a radial face that engages an outer radial surface portion of face 27 of the catalyst element 23. Similarly, at the downstream end, a pressure ring 37 slidably engages the inner shell surface 33 and has a radial face to engage the outer surface portion of the outlet face 29 of the element 23. Spaced axially outwardly from the movable pressure rings 35 and 37 are fixed, L-shaped, spring back-up or retaining rings 39 and 41 which in this embodiment are preferably of material having the same rate of thermal expansion as the shell. The retaining ring 39 has a circumferential portion 43 that is welded to the surface 33 of the shell 5 as indicated in the drawing. Similarly, the retaining ring 41 has a circumferential flange 45 that is welded to the shell 5. The retainer 39 has a radial section 47 that is spaced from the movable pressure ring 35 and the retainer 41 has a radial wall section 49 that is spaced axially from the movable pressure ring 37. Disposed in the space between the wall 47 and the ring 35 is a spring washer 51; and disposed in the space between the wall 49 and the ring 37 is a pair of nested spring washers 53. The spacing between the fixed flanges 47 and 49 and the respective pressure rings 35 and 37 is such that the respective spring washers located between them are under compression at ambient or room temperatures whereby they exert a pressure on the catalyst element 23 to snugly but resiliently hold it in axial position within the shell 5.

The preferred form of spring washer 51 and 53 is a wave washer as shown in FIG. 2. The washer 51 (and 53) is illustrated as solid but it may be split (as, for example, illustrated by phantom lines 54) in a radial direction thereby enabling it to be more inexpensively manufactured from a straight strip of wire or metal having a width corresponding to the radial width of the ring. In FIG. 3 spring washers 55 and 57 are shown and these are of the finger type having axially extending and circumferential oriented tabs or fingers 59 that are bent away from the major section of the ring and adjacent to its outer diameter to provide substantial spring action in an axial direction. The ring 55 has four fingers 59 whereas the ring 57 has three. The number of such fingers as well as their dimensions relative to the rest of the ring, the ring material and heat treatment, provide various means by which the spring rate can be modified. The load-displacement and damping relationships of the wave washers are very flexible and the best of the types of washers illustrated for purposes of the invention. They can be modified by variations in washer material and heat treatment, number of waves, dimensional relationships (e.g. material thickness and width and height of waves), slotted or solid condition, etc. FIG. 4 illustrates a spring washer 60 of the Belleville type which, structurally speaking, is suitable for use in the spring washer retaining chambers 61 and 63 illustrated in FIG. 1. The spring characteristics of washer 60 can be varied by means similar to those just mentioned for washers 51 and 55.

In actual operation as a catalytic converter at elevated temperatures, the shell 5 will tend to expand axially to a greater extent than the refractory catalyst element 23 thereby increasing the axial distance between the fixed flanges 47 and 49. The spring washers, therefore, must be compressed or preloaded at room temperature a sufficient amount so that they remain under compression at elevated temperatures in spite of the increase in axial length of their respective chambers 61 and 63.

As indicated by the nested springs 53, more than one spring washer can be used in order to provide the resilient deflection characteristics required to continuously maintain axial spring pressure on the element 23 at all times and under all conditions once the converter 1 has been assembled. The nested springs may be arranged in series or in parallel as dictated by the dimensional variations for which they must compensate. These can be determined for each specific application by calculation and verified experimentally.

In actual experimentation using a substrate of the type described in the aforementioned U.S. patent having a density of about 44 cubic inches per pound, it has been found desirable to have an initial axial preload of about 200–400 pounds when the element is about 4–6" O.D. and about 4½ inches long. In an A.I.S.I. 409 shell and using one circular X-750 Inconel austenitic stainless steel wave washer of rectangular cross section, a width of about ¼", a thickness of about 0.049", a free or unstressed overall height of about ¼" and a diameter to suit the O.D. of the substrate, satisfactory results were obtained when sufficient preload was applied to compress the washer about 50%, i.e., to about ⅛". In such application for a 3.6" O.D. × 3" length substrate, such a washer of a commercial type had four waves and was preloaded at ambient temperature (about 70° F.) to about 200–300 pounds; for a 4.6" O.D. × 4½" substrate, such a washer had five waves and was preloaded to about 300–400 pounds. It is thought that the washer is subjected to a temperature of about 400°–1200° F. during operation and that there is relatively little hysteresis loss of preload at elevated temperature, though some hysteresis loss (about 5–10%) may be expected due to some minor, permanent changes in microstructure of the X-750 alloy during initial loading at the time of installation.

In general the minimum preload is dependent to a great degree upon the circumferential retainment loading and weight of the catalyst element while the maximum preload is dependent upon the circumferential retainment loading and strength of the substrate since excessive ring 35 and 37 loads will damage it. For substrates of the type referred to above a minimum preload of 100 pounds and preferably 200 pounds is believed to be desirable when applied by a ¼" wide wave spring washer. An upper limit of about 400 pounds is felt to be desirable.

Preferably, the spring washer is composed of material having a greater rate of thermal expansion than the shell 5. For example, if the shell is A.I.S.I. 409 (having a coefficient of thermal expansion of about $7.5 \times 10^{-6}$ in./in./°F.), the spring washers could be composed of X-750 Inconel having a coefficient of about $9.8 \times 10^{-6}$ (80°–1800° F.) or A-286 stainless having a coefficient of about $10.6 \times 10^{-6}$ in./in./°F. In cases where the growth of the outer diameter of the washer is resisted by contact with the inner shell surface, the resulting inwardly directed radial pressure will be converted into increased wave height to add a further compensation for the expansion differential between the metal shell and the refractory substrate.

Referring to FIG. 5, the converter 101 has a shell 105 with an inlet cone 107 and an outlet cone 109 which are all substantially the same as their counterparts in the converter 1. The catalyst element 123 has longitudinally extending gas passages 125 and an inlet face 127 and an outlet face 129 and is radially supported by the resilient annular layer 131 on the inside surface 133 of the shell 105. A radial wall 135 on an L-shaped sleeve 139 engages the inlet face 127 and an outlet face 129 and is radially supported by the resilient annular layer 131 on the inside surface 133 of the shell 105. A radial wall 135 on an L-shaped sleeve 139 engages the inlet face 127 to fix the upstream axial position of the element 123, the member 139 being secured only at its upstream end by a weld 140 to the shell 105. In a manner similar to that illustrated in FIG. 1, the downstream face 129 of the catalyst element 123 is engaged by a movable pressure ring 137 that slidably fits the inside shell surface 133. An L-shaped spring back up ring 141 is secured in fixed position in the shell 105 and it has a radial wall 149 that is spaced from the ring 137 so that the spring washer is received in the chamber 163 between the ring 137 and the flange 149. The spring washer may be any desired form such as those described above with the wave type preferred and the finger type 155 illustrated.

A thermal compensation means is used in converter 101 in accordance with the disclosure of the previously identified U.S. application Ser. No. 342,280. For this purpose the upstream member 139 is formed of a metal that has a greater coefficient of expansion than the metal of the shell 105 and, obviously, a substantially greater coefficient of expansion than the refractory material embodied in the substrate 123. (The downstream member 141 could be used, similarly, if desired.) For example, the member 139 may be formed of A.I.S.I. stainless steel composition 304 which has a coefficient of thermal expansion of about $11.2\times10^{-6}$ in./in./°F. (70°-1800° F.) while the shell 105 can be formed of A.I.S.I. 409 stainless with its coefficient of about $7.5\times10^{-6}$. Since the member 139 is attached at one end only to the shell 105 by the weld 140, it will expand in response to increases in temperature to a greater degree than the shell 105 and thereby compensate to some extent for the significantly lower rate of expansion of the catalyst element 123. The relative amounts of expansion at given temperatures can be calculated, or can be determined experimentally, and the relative parts are dimensioned and arranged so that the element 123 is under axial pressure at all temperatures to which the converter is subjected.

As a matter of manufacturing procedure, the various parts can be assembled inside of the shell 5 (or 105) and axial pressure applied to one or the other of the retainers 39, 41, or 141 until an instrument indicates the proper loading on the spring washers, whereupon the retainer can be affixed in axial position to the shell and thereby maintain the desired axial load on the assembly. After this the caps 7 and 9 (or 107 and 109) can be affixed to the shell. The required preload on the spring washers can be calculated by the engineer for any given design since he knows the lengths and diameters of the parts, the temperature range to which they are subjected, and their coefficients of thermal expansion. This reveals the amount by which the shell expansion will exceed expansion of the refractory and is used to select a specific spring washer or spring washer combination. The preload and amount of initial compression is selected to insure that significant spring pressure is continuously applied to the substrate by these washers. As a rule of thumb the initial compression should be approximately 50% of the free height of a wave washer and more than the excess of shell expansion over substrate expansion. As a further rule of thumb for use when it is not desired to make specific calculations, the free height of the wave washer may be selected to be about 15% of the refractory substrate where one substrate is used in a metal housing generally similar to the one illustrated.

Thus, in accordance with the invention, annular spring washers based inside the housing of a throwaway type catalytic converter are used to exert substantial axially directed spring pressure on the end faces of a monolithic refractory catalyst element. The washers are mounted and arranged in such a way that this pressure is applied when the converter is at ambient temperature and when the converter is at its maximum operating temperature and at all temperatures in between. This feature in conjunction with means providing resilient radial mounting of the element gives total resilient support for the catalyst element in all directions at all times. While round housings are illustrated, the spring washer mounting means is applicable to oval housings and to oval catalyst elements.

I claim:

1. A catalytic converter for combustion engine exhaust systems comprising a metal housing having a longitudinal axis and having an inlet for unpurified exhaust gas at one end and an outlet for relatively purified gas at the other end, a catalyst element in said housing comprising a gas pervious monolithic refractory substrate containing catalyst material and having support faces at opposite ends that are substantially parallel to each other and substantially normal to said axis, a resilient layer around said substrate and resiliently supporting it radially in said housing, said substrate having a gas inlet surface and a gas outlet surface each extending substantially normal to said longitudinal axis, inlet gas passage means providing a gas flow passage between said housing inlet and said substrate inlet surface for unpurified gas, outlet gas passage means providing a gas flow passage between said substrate outlet surface and said housing outlet for relatively purified gas, support means contained inside of said housing serving to axially support said catalyst element in position between said inlet and outlet and including transverse partitions and at least one separate and individual relatively flat layer of spring metal washer means inside said housing and separable from and non-integral with respect to all other parts of said converter and consisting of at least one axially compressed undulated wave spring washer reacting against said partitions and axially movable as a whole relative at least one of the partitions and housing and applying continuous spring pressure to said substrate in a direction substantially parallel to said longitudinal axis and in longitudinal alignment with said support faces, said relatively flat layer of spring metal wsher means constituting the only spring means applying continuous resilient pressure to said substrate in the direction of said longitudinal axis.

2. A converter as set forth in claim 1 wherein said spring means includes a plurality of axially compressed flat metal spring wave washers reacting against said housing and applying continuous spring pressure to said substrate in a direction substantially parallel to said longitudinal axis and in longitudinal alignment with said support faces.

3. A converter as set forth in claim 1 wherein said support means comprises fixed partitions on opposite longitudinal ends of the substrate, a movable partition between one of the fixed partitions and the substrate, said spring metal washer means being compressed between said movable partition and one of said fixed partitions.

4. A converter as set forth in claim 1 wherein said support means comprises fixed partitions on opposite longitudinal ends of the substrate, movable partitions between each fixed partition and the adjacent end of the substrate, and at least one spring metal washer means compressed between each movable partition and adjacent fixed partition.

5. A converter as set forth in claim 1 including one of said relatively flat layers of spring metal washer means at each end of the substrate reacting against said housing and applying continuous spring pressure to said substrate in opposite longitudinal directions substantially parallel to said longitudinal axis and in longitudinal alignment with said support faces.

6. A converter as set forth in claim 5 wherein said housing and substrate are circular in cross section and the support means comprises fixed partitions on opposite longitudinal ends of the substrate and movable partitions between each fixed partition and the adjacent end of the substrate, said spring metal washer means being respectively compressed between each movable partition and adjacent fixed partition.

7. A converter as set forth in claim 1 wherein one of said partitions is fixed relative to the housing and another is movable and located between the fixed partition and the substrate, said wave spring washer being longitudinally compressed in the space between said two partitions.

8. A converter as set forth in claim 7 wherein said wave spring washer is formed of metal having a greater rate of thermal expansion than said housing to provide thermal compensation for the difference in thermal expansion between the housing and substrate.

9. A converter as set forth in claim 8 wherein a preload is maintained on said washer at room temperature of at least one hundred pounds.

10. A converter as set forth in claim 9 wherein said wave spring washer is compressed to about one half of its free height.

11. A converter as set forth in claim 10 wherein said washer has a free height of about 15% of the length of the substrate.

* * * * *